US010760343B2

(12) United States Patent
Wang et al.

(10) Patent No.: US 10,760,343 B2
(45) Date of Patent: Sep. 1, 2020

(54) DRILL BIT, A METHOD FOR MAKING A BODY OF A DRILL BIT, A METAL MATRIX COMPOSITE, AND A METHOD FOR MAKING A METAL MATRIX COMPOSITE

(71) Applicant: Oerlikon Metco (US) Inc., Westbury, NY (US)

(72) Inventors: Zhongming Wang, Houston, TX (US); Andrew Bell, Houston, TX (US); Robert Horswell, Houston, TX (US); Ramamurthy Viswanadham, Spring, TX (US)

(73) Assignee: Oerlikon Metco (US) Inc., Westbury, NY (US)

( * ) Notice: Subject to any disclaimer, the term of this patent is extended or adjusted under 35 U.S.C. 154(b) by 0 days.

(21) Appl. No.: 15/555,942

(22) PCT Filed: May 1, 2017

(86) PCT No.: PCT/US2017/030473

§ 371 (c)(1),
(2) Date: Sep. 5, 2017

(87) PCT Pub. No.: WO2018/203880

PCT Pub. Date: Nov. 8, 2018

(65) Prior Publication Data

US 2019/0071931 A1 Mar. 7, 2019

(51) Int. Cl.
*E21B 10/42* (2006.01)
*E21B 10/54* (2006.01)
(Continued)

(52) U.S. Cl.
CPC ..... *E21B 10/54* (2013.01); *B22D 19/06* (2013.01); *B22D 19/14* (2013.01); *C22C 1/1068* (2013.01);
(Continued)

(58) Field of Classification Search
CPC ..... E21B 10/42; E21B 10/54; B22D 19/06; B22D 19/14; C22C 1/1068; C22C 29/005; C22C 29/08
See application file for complete search history.

(56) References Cited

U.S. PATENT DOCUMENTS 5,373,907 A * 12/1994 Weaver ..... C22C 1/1036 175/426
5,589,268 A 12/1996 Kelley et al.
(Continued)

FOREIGN PATENT DOCUMENTS

WO WO 2017/052504 A1 3/2017

OTHER PUBLICATIONS

Griffo, Anthony, et al., "Infiltration of Carbide Structures," *ASM Handbook, Powder Metallurgy*, vol. 7, P. Samal and J. Newkirk, editors, 3 pgs. (2015).
(Continued)

*Primary Examiner* — Matthew R Buck
(74) *Attorney, Agent, or Firm* — Christensen, Fonder, Dardi & Herbert PLLC

(57) ABSTRACT

A drill bit comprising a body that includes a metal matrix composite (MMC). The MMC comprises a mixture comprising a plurality of particles and another plurality of particles, wherein each of the other plurality of particles is softer than each of the plurality of particles. The MMC comprises a metallic binding material that is metallurgically bonded to each of the plurality of particles and the other plurality of particles.

20 Claims, 5 Drawing Sheets

(51) Int. Cl.

| | |
|---|---|
| ***B22D 19/06*** | (2006.01) |
| ***B22D 19/14*** | (2006.01) |
| ***C22C 29/00*** | (2006.01) |
| ***C22C 29/08*** | (2006.01) |
| ***C22C 1/10*** | (2006.01) |
| *B22F 5/00* | (2006.01) |

(52) U.S. Cl.
CPC ..... *C22C 29/005* (2013.01); *C22C 29/08* (2013.01); *E21B 10/42* (2013.01); *B22F 2005/001* (2013.01)

(56) References Cited

U.S. PATENT DOCUMENTS 5,663,512 A 9/1997 Schader et al.
5,733,649 A 3/1998 Kelley et al.
5,733,664 A 3/1998 Kelley et al.
6,024,776 A * 2/2000 Heinrich ..... C22C 19/07 75/238
6,287,360 B1 * 9/2001 Kembaiyan ..... B22F 7/06 175/374
7,051,783 B1 5/2006 Bojilov et al.
7,250,069 B2 7/2007 Kembaiyan et al.
7,475,743 B2 1/2009 Liang et al.
7,661,491 B2 2/2010 Kembaiyan et al.
7,784,381 B2 * 8/2010 Ladi ..... B22D 19/06 175/425
7,878,275 B2 2/2011 Lockwood et al.
8,016,057 B2 * 9/2011 Deng ..... C22C 9/04 175/327
8,109,177 B2 * 2/2012 Kembaiyan ..... E21B 10/00 76/108.1
8,211,203 B2 * 7/2012 Sheng ..... C22C 19/07 175/374
8,220,566 B2 7/2012 Eason et al.
8,312,941 B2 * 11/2012 Mirchandani ..... E21B 10/00 175/327
8,347,990 B2 1/2013 Lockwood et al.
8,602,129 B2 12/2013 Lockwood et al.
2002/0084111 A1 7/2002 Evans
2004/0060742 A1 4/2004 Kembaiyan et al.
2007/0175669 A1 8/2007 Liang et al.
2007/0240910 A1 10/2007 Kembaiyan et al.
2008/0127781 A1 6/2008 Ladi et al.
2009/0260893 A1 10/2009 Sheng et al.
2009/0283333 A1 11/2009 Lockwood et al.
2009/0283336 A1 11/2009 Lockwood et al.
2010/0038147 A1 2/2010 Lockstedt et al.
2010/0044114 A1 2/2010 Mirchandani et al.
2010/0108399 A1 5/2010 Eason et al.
2010/0116557 A1 5/2010 Lockwood et al.
2010/0206640 A1 8/2010 Lockwood et al.
2010/0288821 A1 11/2010 Ladi et al.
2010/0320004 A1 12/2010 Deng et al.
2011/0114394 A1 5/2011 Lockwood et al.
2011/0120781 A1 5/2011 Lockwood et al.
2011/0174114 A1 7/2011 Lockwood et al.
2011/0266068 A1 * 11/2011 Eason ..... B22D 19/14 175/374
2011/0296765 A1 12/2011 Russell et al.
2011/0297450 A1 * 12/2011 Can ..... C04B 35/528 175/426
2011/0315051 A1 12/2011 Olsen
2012/0017670 A1 1/2012 Olsen
2012/0125694 A1 * 5/2012 Deng ..... C04B 35/5607 175/425
2012/0255793 A1 10/2012 Sheng et al.
2013/0000982 A1 1/2013 Olsen
2013/0133951 A1 5/2013 Olsen
2015/0196991 A1 7/2015 Montross
2016/0008891 A1 * 1/2016 Makino ..... C22C 29/08 407/119
2017/0100771 A1 * 4/2017 Voglewede ..... B22F 5/007

OTHER PUBLICATIONS

Mitra, Rahul, et al., "Interfaces in Discontinuously Reinforced Metal-matrix Composites," *Defence Science Journal*, vol. 43, No. 4, pp. 397-418 (Oct. 1993).

* cited by examiner

DRILL BIT, A METHOD FOR MAKING A BODY OF A DRILL BIT, A METAL MATRIX COMPOSITE, AND A METHOD FOR MAKING A METAL MATRIX COMPOSITE

This present application is a National Phase entry of PCT Application No. PCT/US2017/030473, filed May 1, 2017, which is incorporated herein by reference.

TECHNICAL FIELD

The present disclosure generally, but not exclusively, relates to a drill bit, a method for making a body of a drill bit, a metal matrix composite, and a method for making a metal matrix composite.

BACKGROUND

Earth engaging drill bits are used extensively by industries including the mining, oil and gas industries for exploration and retrieval of minerals and hydrocarbon resources. Examples of earth-engaging drill bits include fixed cutter drill bits ("drag bits").

A drill bit wears when it rubs against either of an earth formation or a metal casing tube. Drill bits fail. A cooling and lubricating drilling fluid is generally circulated through the drill bit using high hydraulic energies. The drilling fluid may contain abrasive particles, for example sand, which when impelled by the high hydraulic energies exacerbate wear at the face of the drill bit and elsewhere.

Drill bits may have a body comprising at least one of hardened and tempered steel, and a metal matrix composite (MMC). A steel drill bit body may have increased ductility and may be favorable for manufacture. A steel drill bit body may be manufactured from a casting and wrought manufacturing techniques, examples of which include but not limited to forging or rolled bar techniques. The steel properties after heat treatment are consistent and repeatable. Fracture of steel-bodied drill bits are infrequent; however, a worn steel drill bit body may be difficult for an operator to repair.

A MMC generally but not necessarily comprises a high-melting temperature ceramic, for example tungsten carbide powder, infiltrated with a single metal or more commonly an alloy, for example copper or a copper-based alloy, having a lower melting temperature than the ceramic powder. MMC's may be made using a premixed powder comprising a metallic powder and a ceramic powder. The premixed powder may be a cermet powder. FIG. 1 shows a light microscopic micrograph of a prior art MMC 1 prepared using metallographic techniques.

The MMC 1 consists of two principle phases. The soft phase 2 is formed through liquid metal infiltration of hard particles 3. The soft phase 2 is in the as-cast condition. Soft phases 2 may be considered as those that are significantly softer than the hard particles 3 and may be classified as having resistance to localized indention less than 1,000 HV, and even less than 250 HV. The elastic modulus of the soft phase 2 is also much lower than that of the hard particles 3.

The hard particles 3 are generally metal carbides, borides or oxides, for example tungsten carbide, tungsten semi-carbide or cemented carbide. The hard particles 3 typically have a resistance to localized indentation greater than 1,000 HV. The hardness of WC (tungsten mono carbide) is 2,200-2,500 HV. Between the soft phase 2 and hard particles 3 there is an interface 4 at which is a bond between the hard particles 3 and the soft phase 2. The bond is in the form of an inter-atomic diffusion of species between the hard particles 3 and soft phase 2. Interfacial strengths may be high due to chemical compatibility. The hard particles 3 act to stiffen, and strengthen the resulting MMC 1 relative to the soft phase 2 alone.

A MMC drill bit body may wear more slowly than a steel drill bit body. MMC drill bit bodies, however, more frequently fracture during casting and/or processing and/or use from thermal and mechanical shock. Fracturing may cause an early removal of a drill bit from service because it may be structurally unsound or have cosmetic defects. Alternatively, the MMC drill bit body may fail catastrophically with the loss of part of the cutting structure, which may result in sub-optimal drilling performance and early retrieval of the drill bit.

In many cases, it is a wing or blade of a drill bit that fractures. Wing or blade failures are economically damaging for drill bit manufacturers. Occurrences on a weekly or monthly basis may impact profitability and reputation. Were a drill bit manufacturer making 300 bits per month, with 1 in every 1,000 bits failing, a fracture event would occur on average approximately once every three months—this may be considered too frequent. One fracture for every 10,000 bits, while still not ideal, may improve the drill bit manufacturer's profit and reputation.

MMCs are generally considered to be a brittle material. Samples from a population of a brittle material objects exhibit strength variations because of unique flaws and defects. The strength of a sample of a MMC may be determined using a Transverse Rupture Strength (TRS) Test, where a load is centrally applied to a cubic or cylindrically shaped MMC sample that is supported between two points. A plurality of samples may be tested to derive a mean strength and a standard deviation of applied stress at the moment of rupture, which are then taken as being representative.

The retrieval of a worn or failed drill bit from a drilled hole, for example a well or borehole, is undesirable. The non-productive time required to retrieve and introduce into the drilled hole a replacement drill bit may cost millions of dollars. Drill bits and other earth-engaging tools with increased wear resistance and lower rates of failure may save considerable time and money.

SUMMARY

Disclosed herein is a drill bit. The drill bit comprises a body that comprises a metal matrix composite (MMC). The MMC comprises a mixture comprising a plurality of particles and another plurality of particles. Each of the other plurality of particles are softer than each of the plurality of particles. The MMC comprises a metallic binding material metallurgically bonded to each of the plurality of particles and the other plurality of particles.

In an embodiment, each of the plurality of particles comprises a first material, each of the other plurality of particles comprises a second material, and the thermal conductivity of the second material is greater than the thermal conductivity of the first material.

In an embodiment, each of the other plurality of particles have a density that is in the range of 0.7-1.3 times that of each of the plurality of particles.

In an embodiment, the thermal conductivity of the first material is no more than 120 $W \cdot m^{-1} K^{-1}$.

In an embodiment, the plurality of particles comprises at least one of a carbide and a nitride.

In an embodiment, the plurality of particles comprises at least one of tungsten carbide, cemented tungsten carbide (WC—Co), cadmium carbide, tantalum carbide, vanadium carbide and titanium carbide.

In an embodiment, the plurality of particles comprises at least one of WC and fused tungsten carbide.

In an embodiment, the mixture comprises 69 wt. %-91 wt. % of WC, 7 wt. %-16 wt % of fused tungsten carbide, 0 wt. %-5% wt. % of iron and 2 wt. %-10 wt. % of tungsten.

In an embodiment, the mixture comprises 80 wt. % of WC, 13 wt. % of fused tungsten carbide, 2 wt. % of iron and 5 wt. % of tungsten.

In an embodiment, the thermal conductivity of the second material is no less than 155 $W \cdot m^{-1} \cdot K^{-1}$.

In an embodiment, the other plurality of particles comprises a metal.

In an embodiment, the other plurality of particles comprises a plurality of tungsten metal particles.

In an embodiment, the metallic binding material comprises copper, manganese, nickel and zinc.

In an embodiment, the metallic binding material comprises 47 wt. %-58 wt. % copper, 23 wt. %-25 wt. % manganese, 14 wt. %-16 wt. % nickel and 7 wt. %-9 wt. % zinc.

In an embodiment, the metallic binding material comprises a monolithic matrix of the metallic binding material.

In an embodiment, each of the plurality of particles has a 635 mesh size of 60 mesh.

In an embodiment, each of the other plurality of particles has a 635 mesh size of 325 mesh.

In an embodiment, the interstices between the plurality of particles contain the other plurality of particles.

In an embodiment, the volume fraction of the plurality of particles in the MMC is at least 60% by volume.

In an embodiment, the volume fraction of the other plurality of particles in the MMC is at least 5% by volume.

In an embodiment, the plurality of particles each have a hardness greater than 1,000 HV.

In an embodiment, the other plurality of particles each have a hardness of less than 350 HV.

In an embodiment, the MMC has a stiffness of greater than 280 GPa.

In an embodiment, the MMC has a stiffness of less than 400 GPa.

In an embodiment, the MMC has a transverse rupture strength greater than 700 MPa.

In an embodiment, the MMC has a transverse rupture strength less than 1,400 MPa.

In an embodiment, the MMC has a Weibull modulus greater than 20.

In an embodiment, the metallic binding material has infiltrated the mixture.

An embodiment comprises an earth-engaging drag drill bit.

Disclosed herein is a method for making a body of a drill bit. The method comprises a MMC.

The method comprises the step of disposing in a mold configured for forming the body of the drill bit a mixture comprising a plurality of particles and another plurality of particles. Each of the other plurality of particles are softer than each of the plurality of particles. The method comprises the step of metallurgically bonding a metallic binding material to each of the plurality of particles and each of the other plurality of particles.

An embodiment comprises the step of infiltrating the mixture with the metallic binding material.

In an embodiment, the step of infiltrating the mixture with the metallic binding material comprises disposing the metallic binding material on the mixture so disposed in the mold, heating the metallic binding material to form a molten metallic binding material, and allowing the molten metallic binding material to downwardly infiltrate the mixture.

An embodiment comprises the step of cooling the molten metallic binding material that has so downwardly infiltrated the mixture to form a monolithic matrix of the metallic binding material.

In an embodiment, the step of disposing in the mold the mixture comprises the step of disposing the mixture in the mold and subsequently vibrating the mold to compact the mixture.

In an embodiment, each of the plurality of particles comprises a first material, each of the other plurality of particles comprises a second material, and the thermal conductivity of the second material is greater than the thermal conductivity of the first material.

In an embodiment, each of the other plurality of particles have a density that is in the range of 0.7-1.3 times that of each of the plurality of particles.

In an embodiment, the thermal conductivity of the first material is no more than 120 $W \cdot m^{-1} \cdot K^{-1}$.

In an embodiment, the plurality of particles comprises at least one of a carbide and a nitride.

In an embodiment, the plurality of particles comprises at least one of tungsten carbide, cemented tungsten carbide (WC—Co), cadmium carbide, tantalum carbide, vanadium carbide, and titanium carbide.

In an embodiment, the plurality of particles comprises at least one of WC and fused tungsten carbide.

In an embodiment, the mixture comprises 69 wt. %-91 wt. % of WC, 7 wt. %-16 wt. % of fused tungsten carbide, 0 wt. %-5 wt. % of iron and 2 wt. %-10 wt. % of tungsten.

In an embodiment, the mixture comprises 80 wt. % of WC, 13 wt. % of fused tungsten carbide, 2 wt. % of iron and 5 wt. % of tungsten.

In an embodiment, the thermal conductivity of the second material is no less than 155 $W \cdot m^{-1} \cdot K^{-1}$.

In an embodiment, the other plurality of particles comprises a metal.

In an embodiment, the other plurality of particles comprises a plurality of tungsten metal particles.

In an embodiment, the metallic binding material comprises copper, manganese, nickel and zinc.

In an embodiment, the metallic binding material comprises 47 wt. %-58 wt. % copper, 23 wt. %-25 wt. % manganese, 14 wt. %-16 wt. % nickel and 7 wt. %-9 wt. % zinc.

In an embodiment, the metalurgically bonded metallic binding material comprises a monolithic matrix of the metallic binding material.

In an embodiment, each of the plurality of particles has a 635 mesh size of 60 mesh.

In an embodiment, each of the other plurality of particles has a 635 mesh size of 325 mesh.

In an embodiment, the volume fraction of the plurality of particles in the MMC is at least 60% by volume.

In an embodiment, the volume fraction of the other plurality of particles in the MMC is at least 5% by volume.

In an embodiment, the plurality of particles each have a hardness greater than 1,000 HV.

In an embodiment, the other plurality of particles each have a hardness of less than 350 HV.

In an embodiment, the MMC has a stiffness of greater than 280 GPa.

In an embodiment, the MMC has a stiffness of less than 400 GPa.

In an embodiment, the MMC has transverse rupture strength greater than 700 MPa.

In an embodiment, the MMC has transverse rupture strength of less than 1,400 MPa.

In an embodiment, the MMC has a Weibull modulus greater than 20.

Disclosed herein is a MMC. The MMC comprises a mixture comprising a plurality of particles and another plurality of particles. Each of the other plurality of particles are softer than each of the plurality of particles. The MMC comprises a metallic binding material metallurgically bonded to each of the plurality of particles and the other plurality of particles.

In an embodiment, each of the plurality of particles comprises a first material, each of the other plurality of particles comprises a second material, and the thermal conductivity of the second material is greater than the thermal conductivity of the first material.

In an embodiment, each of the other plurality of particles have a density that is in the range of 0.7-1.3 times that of each of the plurality of particles.

In an embodiment, the thermal conductivity of the first material is no more than 120 $W \cdot m^{-1} \cdot K^{-1}$.

In an embodiment, the plurality of particles comprises at least one of a carbide and a nitride.

In an embodiment, the plurality of particles comprises at least one of tungsten carbide, cemented tungsten carbide (WC—Co), cadmium carbide, tantalum carbide, and titanium carbide.

In an embodiment, the plurality of particles comprises at least one of WC and fused tungsten carbide.

In an embodiment, the mixture comprises 69 wt. %-91 wt. % of WC, 7 wt. %-16 wt. % of fused tungsten carbide, 0 wt. %-5 wt. % of iron and 2 wt. %-10 wt. % of tungsten.

In an embodiment, the mixture comprises 80 wt. % of WC, 13 wt. % of fused tungsten carbide, 2 wt. % of iron and 5 wt. % of tungsten.

In an embodiment, the thermal conductivity of the second material is no less than 155 $W \cdot m^{-1} \cdot K^{-1}$.

In an embodiment, the other plurality of particles comprises a metal.

In an embodiment, the other plurality of particles comprises a plurality of tungsten metal particles.

In an embodiment, the metallic binding material comprises copper, manganese, nickel and zinc.

In an embodiment, the metallic binding material comprises 47 wt. %-58 wt. % copper, 23 wt. %-25 wt. % manganese, 14 wt. %-16 wt. % nickel and 7 wt. %-9 wt. % zinc.

In an embodiment, the metallic binding material comprises a monolithic matrix of the metallic binding material.

In an embodiment, the density of each of the other plurality of particles is within 30% of the density of each of the plurality of particles.

In an embodiment, each of the plurality of particles has a 635 mesh size of 60 mesh.

In an embodiment, each of the other plurality of particles has a 635 mesh size of 325 mesh.

In an embodiment, the interstices between the plurality of particles contain the other plurality of particles.

In an embodiment, the volume fraction of the plurality of particles in the MMC is at least 60% by volume.

In an embodiment, the volume fraction of the other plurality of particles in the MMC is at least 5% by volume.

In an embodiment, the plurality of particles each have a hardness greater than 1,000 HV In an embodiment, the other plurality of particles each have a hardness of less than 350 HV.

In an embodiment, the MMC has a stiffness of greater than 280 GPa.

In an embodiment, the MMC has a stiffness of less than 400 GPa.

In an embodiment, the MMC has transverse rupture strength greater than 700 MPa.

In an embodiment, the MMC has transverse rupture strength less than 1,400 MPa.

In an embodiment, the MMC has a Weibull modulus greater than 20.

In an embodiment, the metallic binding material has infiltrated the mixture.

Disclosed herein is a method for making a MMC. The method comprises the step of disposing in a mold a mixture comprising a plurality of particles and another plurality of particles. Each of the other plurality of particles are softer than each of the plurality of particles. The method comprises the step of metallurgically bonding the metallic binding material to each of the plurality of particles and each of the other plurality of particles.

In an embodiment, the step of infiltrating the mixture with the metallic binding material comprises disposing the metallic binding material on the mixture so disposed in the mold, heating the metallic binding material to form a molten metallic binding material, and allowing the molten metallic binding material to downwardly infiltrate the mixture.

An embodiment comprises the step of cooling the molten metallic binding material that has so downwardly infiltrated the mixture to form a monolithic matrix of the metallic binding material.

In an embodiment, the step of disposing in the mold the mixture comprises the step of disposing the mixture in the mold and subsequently vibrating the mold to compact the mixture.

In an embodiment, each of the plurality of particles comprises a first material, each of the other plurality of particles comprises a second material, and the thermal conductivity of the second material is greater than the thermal conductivity of the first material.

In an embodiment, each of the other plurality of particles have a density that is in the range of 0.7-1.3 times that of each of the plurality of particles.

In an embodiment, the thermal conductivity of the first material is no more than at least one of 120 $W \cdot m^{-1} \cdot K^{-1}$.

In an embodiment, the plurality of particles comprises at least one of a carbide and a nitride.

In an embodiment, the plurality of particles comprises at least one of tungsten carbide, cemented tungsten carbide (WC—Co), cadmium carbide, tantalum carbide, and titanium carbide.

In an embodiment, the plurality of particles comprises at least one of WC and fused tungsten carbide.

In an embodiment, the mixture comprises 69 wt. %-91 wt. % of WC, 7 wt. %-16 wt. % of fused tungsten carbide, 0 wt. %-5 wt. % of iron and 2 wt. %-10 wt. % of tungsten.

In an embodiment, the mixture comprises 80 wt. % of WC, 13 wt. % of fused tungsten carbide, 2 wt. % of iron and 5 wt. % of tungsten.

In an embodiment, the thermal conductivity of the second material is no less than 155 $W \cdot m^{-1} \cdot K^{-1}$.

In an embodiment, the other plurality of particles comprises a metal.

In an embodiment, the other plurality of particles comprises a plurality of tungsten metal particles.

In an embodiment, the metallic binding material comprises copper, manganese, nickel and zinc.

In an embodiment, the metallic binding material comprises 47 wt. %-58 wt. % copper, 23 wt. %-25 wt. % manganese, 14 wt. %-16 wt. % nickel and 7 wt. %-9 wt. % zinc.

In an embodiment, the metalurgically bonded metallic binding material comprises a monolithic matrix of the metallic binding material.

In an embodiment, the density of each of the other plurality of particles is within 30% of the density of each of the plurality of particles.

In an embodiment, each of the plurality of particles has a 635 mesh size of 60 mesh.

In an embodiment, each of the other plurality of particles has a 635 mesh size of 325 mesh.

In an embodiment, the volume fraction of the plurality of particles in the MMC is at least 60% by volume.

In an embodiment, the volume fraction of the other plurality of particles in the MMC is at least 5% by volume.

In an embodiment, the plurality of particles each have a hardness greater than 1,000 HV.

In an embodiment, the other plurality of particles each have a hardness of less than 350 HV.

In an embodiment, the MMC has a stiffness of greater than 280 GPa.

In an embodiment, the MMC has a stiffness of less than 400 GPa.

In an embodiment, the MMC has transverse rupture strength greater than 700 MPa.

In an embodiment, the MMC has transverse rupture strength of less than 1,400 MPa.

In an embodiment, the MMC has a Weibull modulus greater than 20.

Any of the various features of each of the above disclosures, and of the various features of the embodiments described below, can be combined as suitable and desired.

BRIEF DESCRIPTION OF THE FIGURES

Embodiments will now be described by way of example only with reference to the accompanying figures in which.

DESCRIPTION OF EMBODIMENTS

Figure 2:
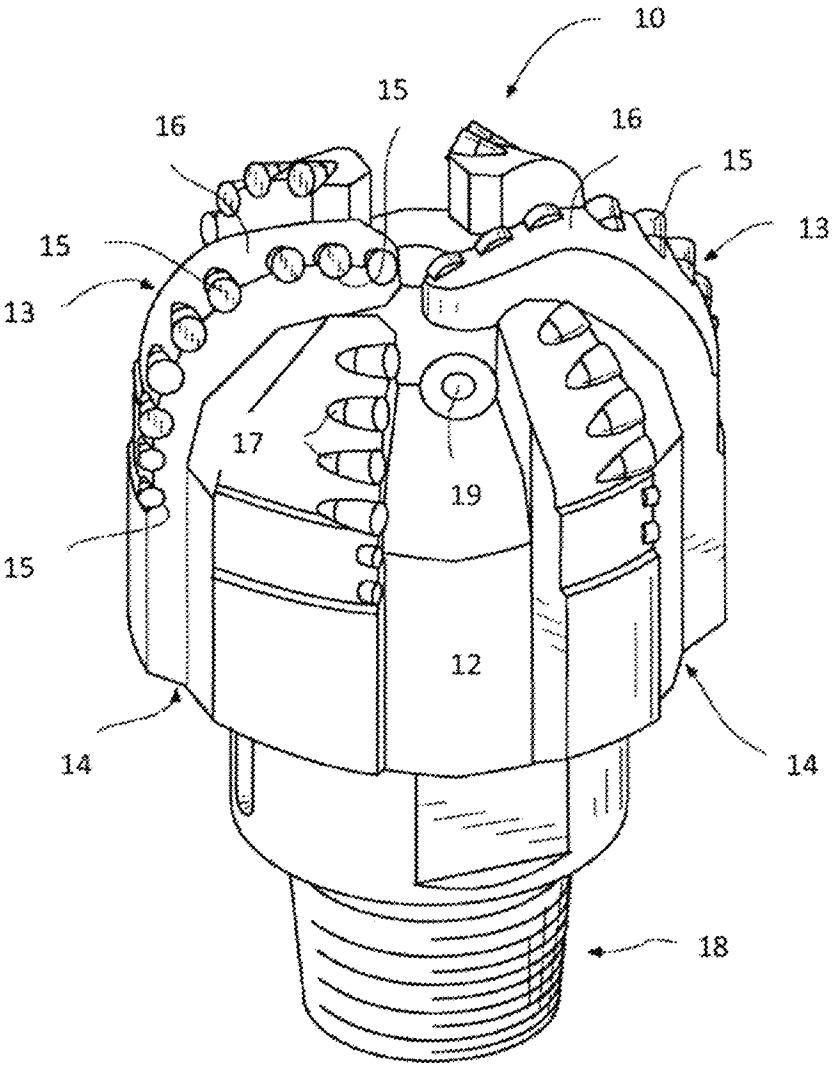
FIG. 2 shows a perspective view of an embodiment of a drill bit comprising an embodiment of a MMC ("MMC 2").
Figure 3:
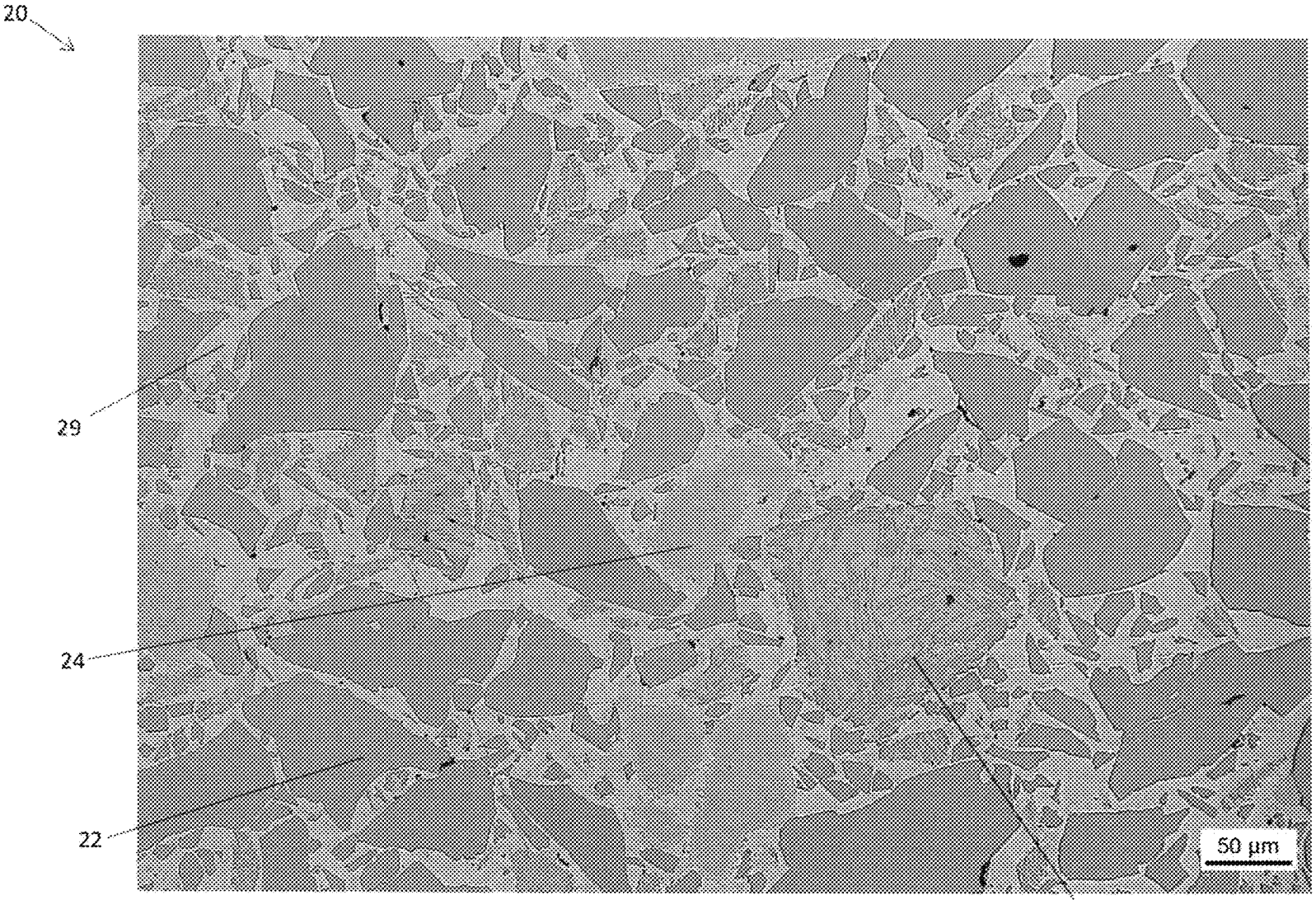
FIG. 3 shows a light micrograph a sample of "MMC 2" prepared using metallographic techniques.

FIG. 2 shows a perspective view of an embodiment of a drill bit in the form of a fixed cutter drill bit ("drag bit") which comprises a bit body 12 comprising a metal matrix composite (MMC) 20. FIG. 3 shows a light micrograph of a sample of the MMC 20 prepared using metallographic techniques. The MMC 20 comprises a mixture, which comprises a plurality of particles 22 and another plurality of particles 24. Each of the other plurality of particles 24 are softer than each of the plurality of particles 22. The mixture comprises a metallic binding material 29 metallurgically bonded to each of the plurality of particles 22 and the other plurality of particles 24.

The metallurgical bonds disclosed herein may comprise diffused atoms and/or atomic interactions, and may include chemical bonds. A metallurgical bond is more than a mere mechanical bond. Under such conditions, the component parts may be "wetted" to and by the metallic binding material.

In the present embodiment, the plurality of other particles 24 comprise a plurality of metallic tungsten particles. Before being incorporated into the MMC, the mixture is in the form of a powder. Powders containing a plurality of soft particles are generally not a material input of MMC manufacturing, however, it has been understood that cheaper powders containing iron particles, which a relatively soft and that displace carbide particles, may be used as a material input, but at the expense of wear resistance. The hardness of iron is generally accepted to be around 30-80 HV. Improving wear resistance and strength of an MMC by displacing carbide for metallic tungsten is contrary to that understanding in view of carbides superior wear resistance to metallic tungsten.

The metallic binding material 29 may, for example, be generally any suitable brazing metal, including copper, chromium, tin, silver, cobalt nickel, cadmium, manganese, zinc and cobalt or an alloy of two or more of the metals. A quaternary material system may be used. A chromium component may harden the alloy formed. The metallic binding material may also contain silicon and/or boron powder to aid in fluxing and deposition characteristics. In the present embodiment, the binding material is a quaternary system comprising copper (47 wt. %-58 wt. %), manganese (23 wt. %-25 wt. %), nickel (14 wt. %-16 wt. %) and zinc (7 wt. %-9 wt. %). The applicant has established that this composition provides a desirable combination of properties for liquid metal infiltration and the resulting mechanical properties of the MMC. The metallic binding material has, in this embodiment, infiltrated the mixture.

Structural features of the drill bit 10, will now be described, however other embodiments of a drill bit may have some or none of the described structural features, or may have other structural features. The bit body 12 has protrusions in the form of radially projecting and longitudinally extending wings or blades 13, which are separated by channels at the face 16 of the drill bit 10 and junk slots 14 at the sides of the drill bit 10. A plurality of cemented tungsten carbide, natural industrial-grade diamonds or polycrystalline diamond compacts (PDC) cutters 15 may be brazed, attached with adhesive or mechanically attached within pockets on the leading faces of the blades 13 extending over the face 16 of the bit body 12. The PDC cutters 15 may be supported from behind by buttresses 17, for example, which may be integrally formed with the bit body 12. Generally any suitable form of hard cutting elements may be used.

The drill bit 10 may further include a shank 18 in the form of an API threaded connection portion for attaching the drill bit 10 to a drill string (not shown). Furthermore, a longitudinal bore (not shown) extends longitudinally through at least a portion of the bit body 12, and internal fluid passageways (not shown) provide fluid communication between the longitudinal bore and nozzles 19 provided at the face 16 of the bit body 12 and opening onto the channels leading to junk slots 14 for removing the drilling fluid and earth formation cuttings from the drill face. The drill sting may comprise a series of elongated tubular segments connected end-to-end that extends into the well from the surface of the earth, either directly or via intermediate down-hole components that combined with the drill bit 10 to constitute a bottom hole assembly. The bottom hole assembly may comprise a downhole motor for rotating the drill bit 10, or the drill string may be rotated from the surface to rotate the drill bit 10.

During earth formation cutting, the drill bit 10 is positioned at the bottom of a hole and rotated while weight-on-bit is applied. A drilling fluid—for example a drilling mud delivered by the drill string to which the drill bit is attached—is pumped through the bore, the internal fluid passageways, and the nozzles 19 to the face 16 of the bit body 12. As the drill bit 10 is rotated, the PDC cutters 15 scrape across, and shear away, the underlying earth formation. The earth formation cuttings mix with, and are suspended within, the drilling fluid and pass through the junk slots 14 and up through an annular space between the wall of the hole (in the form of a well or borehole, for example, and the outer surface of the drill string to the surface of the earth formation.

Each of the plurality of particles comprises a first material, and each of the other plurality of particles comprises a second material. The thermal conductivity of the second material is greater than the thermal conductivity of the first material. The thermal conductivity of the first material is no more than 120 $W \cdot m^{-1} \cdot K^{-1}$. The thermal conductivity of the second material is no less than 155 $W \cdot m^{-1} \cdot K^{-1}$. While in the present embodiment the other material is metallic tungsten, it may comprise another material in another embodiment. The plurality of particles may comprise at least one of a carbide and a nitride, for example at least one of tungsten carbide (which may be WC or fused tungsten carbide—otherwise known as cast tungsten carbide—for example), cemented tungsten carbide (WC—Co), cadmium carbide, tantalum carbide, vanadium carbide, and titanium carbide.

In the present but not all embodiments, the mixture comprises 69%-91% by weight of WC, 7%-16% by weight of fused tungsten carbide, 0-5% by weight of iron and 2-10% by weight of tungsten. Specifically, the mixture comprises 80 wt. % of WC, 13 wt. % of fused tungsten carbide 23, 2 wt. % of iron and 5 wt. % of tungsten, although other proportions and compositions may be used in other embodiments. Fused tungsten carbide 23 is a mixture of WC and tungsten semicarbide ($W_2C$). A plurality of fused tungsten carbide particles 23 are in this embodiment a component of the plurality of particles 22, however they may not be in another embodiment. Cast tungsten carbide comprises $W_2C$ and WC which may be used in some alternative embodiments. Tungsten carbide may be single grained tungsten carbide or polycrystalline tungsten carbide. Cemented tungsten carbide may be used in some alternative embodiments. The inclusion of iron may aid the infiltration of the metallic binder into the mixture skeleton.

Each of the other plurality of particles may have a density that is in the range of 0.7-1.3 times that of each of the plurality of particles.

While various particle sizes may be used, in this embodiment each of the plurality of particles has a 635 mesh size of 60 mesh. Each of the other plurality of particles has a 635 mesh size of 325 mesh. The particle size distributions are Gaussian or near Gaussian in the present embodiment. A high packing density may be achieved which may provide strength and reliability. The particle size distribution may be non-Gaussian in another embodiment. The applicants tested samples comprising particles of various sizes and established that the samples having particles of the above mesh sizes had the best Weibull modulus and TRS. The interstices between the plurality of particles contain the other plurality of particles. The volume fraction of the plurality of particles in the MMC may be at least 60% by volume. The volume fraction of the other plurality of particles in the MMC may be at least 5% by volume.

The plurality of particles may each have a hardness greater than 1,000 HV. The other plurality of particles may each have a hardness of less than 350 HV. The MMC may have a stiffness of greater than 280 GPa. The MMC may have a stiffness of less than 400 GPa.

Figure 4:
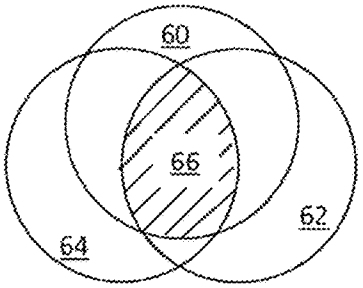
FIG. 4 is a Venn diagram for three sets of desirable attributes of particles for the MM2.

FIG. 4 is a Venn diagram of three sets of desirable attributes. One set of particles 60 is a set of particles having a density similar to tungsten carbide. For example, the density of the soft particles may be less than 30% different to the density of the hard particles. Another set of particles 62 are those particles that metallurgically bond to, and are wetted by, a copper based metallic alloy binder. Another set of particles 64 is the set of particles that if included in the MMC would increase thermal shock resistance thereof. The shaded area 66 is the intersection of the sets, and represents the set of soft particles that may be used in an embodiment of the metal matrix composite 20 and when so used may increase the TSR and may reduce fracture frequency.

The MMC 20 may have a TRS greater than 700 MPa. The MMC 20 may have a TRS less than 1,400 MPa. While the strength of a sample of a MMC may be determined using a TRS Test, the applicants have determined that the statistical results of the TRS test generally do not:

- indicate the likelihood of failure
- access the probability of failure at a given stress value
- allow measurement of changes or improvements to powder compositions and the MMCs made with the powders, in particular the relationship between stress and reliability.

The applicant has found that the strength distribution in a population of samples of the MMC 20 used in the drill bit 10 may be determined using Weibull statistics, which is a probabilistic approach that enables a probability of failure to be established at a given applied stress. The applicant has established that embodiments of MMCs that may be used in embodiments of an earth-engaging tool 10, for example, are generally faithful to a Weibull distribution.

A Weibull strength distribution is described by:

$$F = 1 - e;\left[-V\left(\frac{\sigma - \sigma_u}{\sigma_0}\right)^m\right]$$

The variables in the equation are: F is the probability of failure for a sample; $\sigma$ is the applied stress; $\sigma_u$ is the lower limit stress needed to cause failure, which is often assumed to be zero; $\sigma_0$ is the characteristic strength; m is the Weibull modulus, a measure of the variability of the strength of the material; and V is the volume of the sample.

The above equation is typically rearranged and presented on a double logarithm plot of (1/(1−F)) versus logarithm of $\sigma$ and the slope used to calculate m, assuming $\sigma_u$ is zero. Traditional ceramics may have a Weibull modulus <3, engineered ceramics may have a Weibull modulus in the range of 5-10, cemented WC/Co may have a Weibull modulus in the range of 6-63, cast iron may has a Weibull modulus of 30-40, and Aluminum and steel may have Weibull moduli in the range of 90-100.

Figure 1:
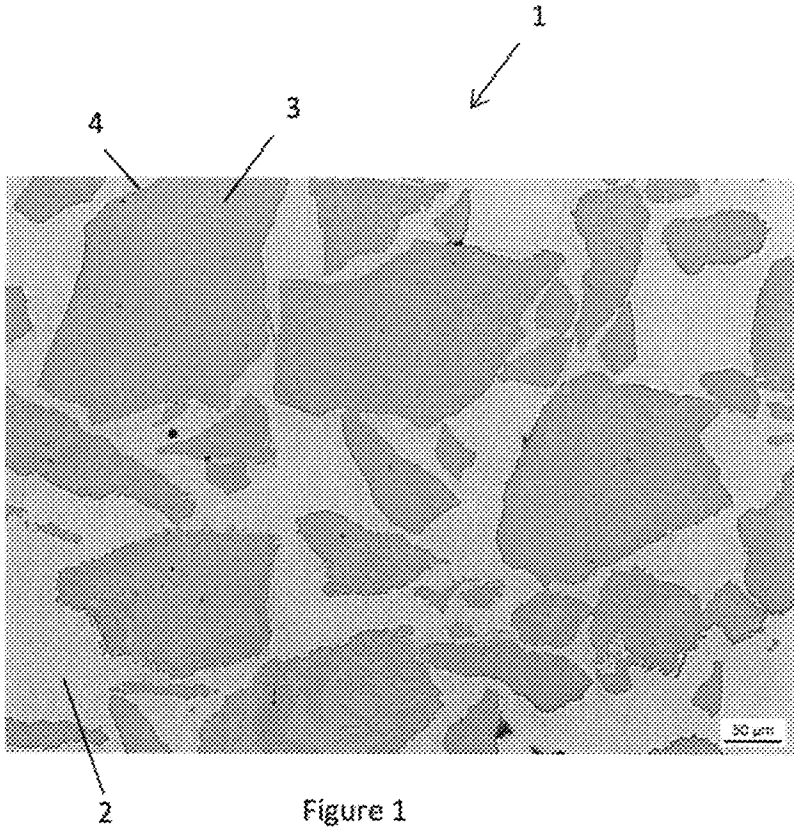
Figure 1 (Prior art)
FIG. 1 shows a light microscopic micrograph of a prior art MMC ("MMC 1") prepared using metallographic techniques.
Figure 5:
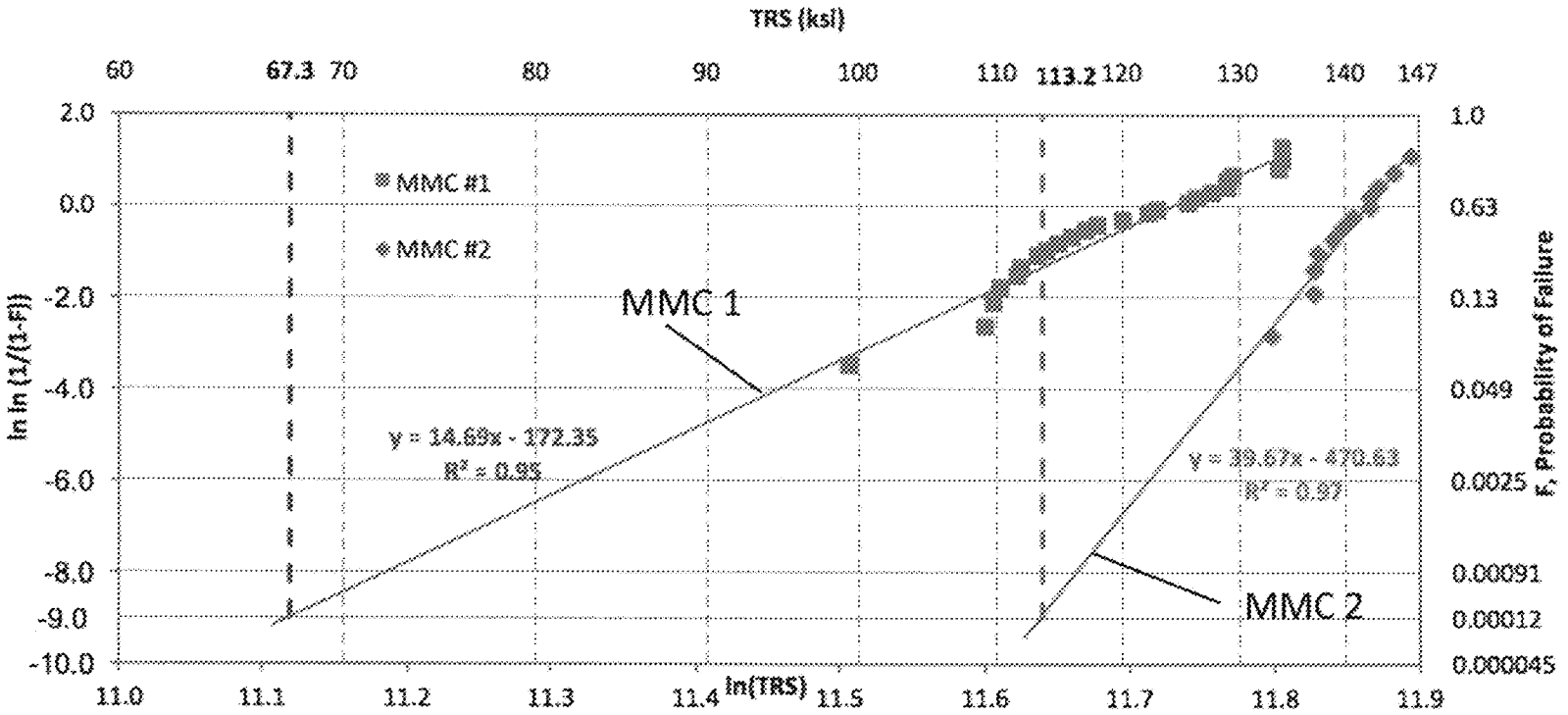
FIG. 5 shows a Weibull plot of empirical strength data for a plurality of samples of the same type of MMC as that of FIG. 1 and a plurality of samples of the same type of MMC as that of FIG. 3.

FIG. 5 shows a Weibull plot of empirical strength data for a plurality of samples of the same type of MMC as that of FIG. 1 ("MMC 1") and a plurality of samples of the MMC of FIG. 3 ("MMC 2"), that is the MMC from which the body of drag bit 10 comprises. The left hand axis values are indicative of a function of the probability of failure, the right hand values are indicative of a percentage probability of failure, and the bottom axis values are indicative of a function of the applied stress at the time of failure during a TRS test. The empirical strength data for the samples of MMC 1 and the sample of MMC 2 each follow a Weibull distribution. The slope of each line defines the respective Weibull moduli. The first MMC has a Weibull modulus of approximately 14.69 and the second MMC has a Weibull modulus of approximately 39.67. Generally, but not necessarily, embodiments of the present invention comprise a MMC having a Weibull modulus greater than 20.

The stress required to fail the best performing sample of the MMC 1 was similar to the stress required to fail the worst performing sample of the MMC 2.

Linear extrapolation to a 1 in 10,000 probability of failure equates to applied stress of about 67.3 ksi and 113.2 ksi for MMC 1 and MMC 2 respectively. Under an applied stress of 113.2 ksi, MMC 2 has about a 1 in 10,000 probability of failure. For the same applied stress of 113.2 ksi the MMC 1 has approximately a 50% or 1 in 2 probability of failure. Under these pressure conditions, the second MMC is around 5,000 times more reliable. Using such an approach used within laboratory test pieces can be considered to be relevant and appropriate to the reliability of a MMC containing drill bit body.

A Weibull plot can be used to design drill bit body blade heights and widths to a predetermined failure rate, and particularly how thin and tall the drill bit body blades can be for the predetermined failure rate. A taller and thinner blade may remove an earth formation faster than a shorter wider blade, however it may have an unacceptable probability of failure. Alternatively, the reliability of a drill bit comprising MMC 1 can be compared to the reliability of another identically configured drill bit comprising MMC 2. These calculations cannot be performed using mean and standard deviation strength values derived from a TRS test.

There may be a plurality of thermal cycles during the making of a MMC drill bit body 12. In any one of the plurality of cycles the MMC drill bit body 12 being formed is heated and cooled. The MMC drill bit body 12 may fracture as a result of thermal shock during manufacture, for example. Examples include the need to re-heat and cool the drill bit body to de-braze and re-braze cutting elements. Pre-heating the bit is undertaken to ensure successful brazing and temperatures can be of the order of 400-600 degrees Celsius. Cutter positions are locally heated either directly or within surrounding regions well beyond the liquidus of the silver solder braze alloy. It is anticipated that temperatures could be in the range of 750-1000 degrees Celsius. After brazing the drill bit body is allowed to cool. Cooling may be forced through the use of a fan or cooled slowly using a thermal blanket to cover the drill bit. Repeated brazing operations may be undertaken during the lifetime of the bit. Rapid heating and cooling is considered to contribute to the overall residual stress within the drill bit body. Rapid heating can be considered as up-shock and cooling as down-shock.

The probability of thermal fracture of a MMC drill bit body during manufacture and use is dependent on the TSR of the MMC and its precursor materials. One mathematical function for determining an estimate of TSR is:

$$T \cong \frac{\sigma k(T)}{E(T)\alpha(T)}$$

The variables in the mathematical function are: σ—mean TRS; k—thermal conductivity of the MMC; B—dynamic Young's modulus of the MMC; α—coefficient of thermal expansion of the MMC.

The comparison of the TSR of different MMCs may be made to determine their Relative Thermal Shock Resistance (RTSR). Although cracking behavior cannot be predicted, a prediction may be made whether one particular MMC has a higher RTSR and in turn a decreased propensity or likelihood of cracking either in up-shock or down-shock.

High strength, high thermal conductivity and reduced elastic moduli and reduced thermal expansion are considered advantageous. In the past, it has not been known how to achieve these conditions in a MMC.

Reliability considerations for the successful design and use of MMCs in the construction of drill bit bodies have been disclosed. The use of Weibull statistics may enable a probabilistic approach to failure to be established. Designing for an improved RTSR postpones, eliminates or reduces cracking events from repeated thermal cycles. It may be therefore understood that any developed MMC has a desirable combination of both, without detracting from the ability to manufacture or unduly compromise wear resistance.

Figure 7:
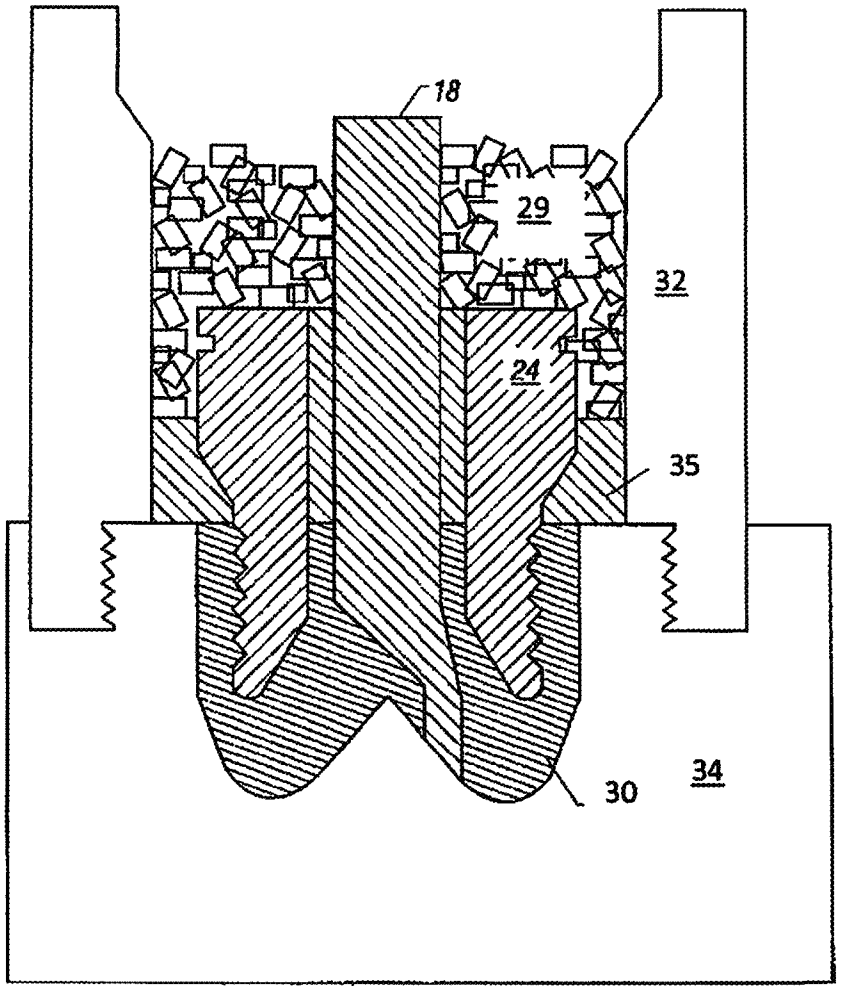
FIG. 7 shows a cut away view of example of a mold being used for making the body of the drill bit of FIG. 2.
Figure 6:
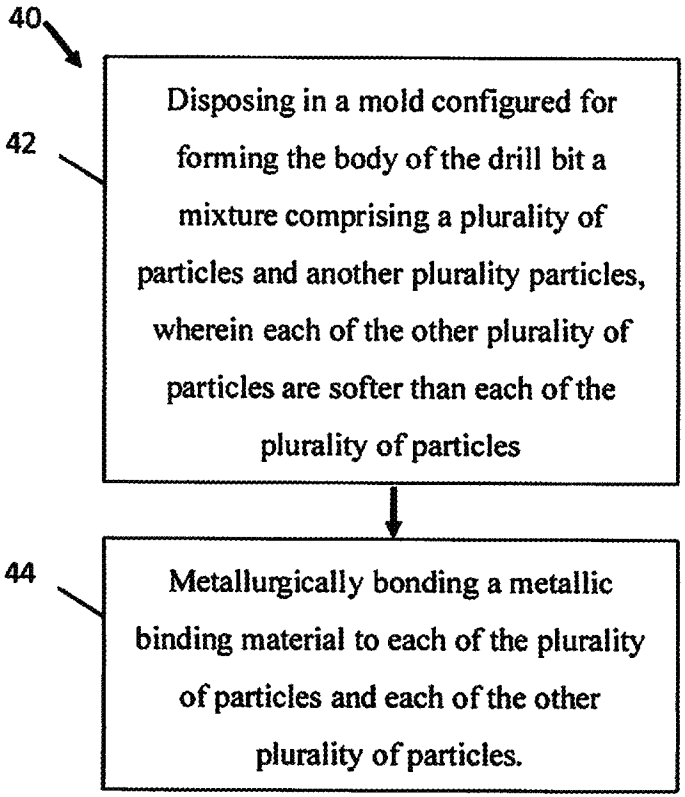
FIG. 6 shows a flow chart for an embodiment of a method for making a body of the drill bit of FIG. 2.

Increasing the number of elements per unit volume may generally improve the wear resistance of the MMC 20. Consequently, close packing may provide relatively high structural integrity by relatively better joining of the plurality of round particles and largely avoid defects that may be encountered in brazed material systems caused by interparticle distances that are too large. FIG. 6 shows a flow chart for an embodiment of a method 40 for making a body of a drill bit 10 comprising the MMC 20. The embodiment of the method will be described with reference to FIG. 7, which shows an example of a mold for making the body 12 of the drill bit 10. A step 42 of the embodiment of the method 40 comprises disposing the mixture 30 in the mold 32, 34 configured for forming the body of the drill bit 20, the mixture 30 comprising the plurality of particles 22 and the other plurality of particles 24. A step 44 comprises metallurgically bonding the metallic binding material 29 to each of the plurality of particles and each of the other plurality of particles. The mold 32, 34 may be, for example, configured as a negative of the drill bit 10. The mold 32, 34 may comprise machinable graphite or cast ceramic.

In this but not necessarily all embodiments, tungsten metal powder 35 is disposed adjacent (and above) the mixture 30.

The mixture 30 is infiltrated with the metallic binding material 29 when molten. The metallic binding material when first disposed in the mold 32,34 may be in the form of nuggets, wire, rods or grains. The metallic binding material 29 is in this embodiment disposed over the mixture 30, and then the metallic binding material 29 is heated to form a molten metallic binding material 29. The molten metallic binding material 29 is allowed to downwardly infiltrate interstices within the mixture 30. The mixture 30 comprises a network of solid particles that provides a system of interconnected pores and channels for capillary force action to draw the molten metallic binding material 29 therethrough. The metallic binding material 29 penetrates the skeletal structure formed by the mixture 30, and generally fills the internal voids and/or passageways, to form a web. This provides additional mechanical attachment of the mixture.

The metallic binding material 29 when added to the mold 32, 34 may also additionally contain silicon and/or boron powder to aid in fluxing and deposition characteristics. Fluxing agents may also be added to the metallic binding material. These may be self-fluxing and/or chemical fluxing agents. Examples of self-fluxing agents including silicon and boron, while chemical fluxing materials may comprise borates.

The molten metallic binding material first infiltrates the tungsten metal powder 35 and then infiltrates the tungsten carbide based powder 30. The air within the interstices of the tungsten powder 35 and the mixture 30 is displaced by the molten metallic binding material and then freezes so that the interstices are filled with solid metallic binding material. Consequently, the infiltrated powder 35 and the infiltrated mixture 30 form two distinct MMCs. During the loading of tungsten powder 35 on to the tungsten carbide powder 30, some mixing of the two powders may occur.

To heat the metallic binding material 29, the mold 32, 34 are placed in a furnace and heat is applied to the mold 32, 34 and metallic binding material 29 so that the metallic binding material 29 melts. Suitable furnace types may include, for example, batch and pusher-type furnaces, electrical, gaseous, microwave or induction furnace, or generally any suitable furnace. The furnace may have an unprotected atmosphere, a neutral atmosphere, a protective atmosphere comprising hydrogen, an air atmosphere, or a nitrogen atmosphere, for example. The heating time and the temperature of the furnace are selected for the metallic binding material 29. For example, for the present embodiment in which a copper alloy braze metallic binding material is used, the mold 32, 34 may be kept in a furnace having an internal temperature of between 1,100-1,200 degrees centigrade for to 60 to 300 minutes, for example. On cooling, the metallic binding material 29 forms a matrix in the form of a monolithic matrix of metallic binding material 29 that binds the plurality of particles and the plurality of other particles to form a body of composite material in the form of a MMC. A metallurgical bond is formed between the mixture 30 and the metallic binding material 29. The metallic binding material 29 may also, as in this embodiment, form a metallurgical bond with any other interstitial particles that may be included.

The infiltration process may improve tool performance by eliminating porosity without applying external pressure via a liquid metal. Infiltration generally may occur when an external source of liquid comes into contact with a porous component and is pulled there though via capillary pressure.

The mold 32, 34 may be separated from the tool 10 by unscrewing a tube portion 32 from a base portion 34 and then tapping the mold, or alternatively be separated from the tool 10 by a mechanical or cutting technique, for example grinding, milling, using a lathe, sawing, chiseling, etc.

Within the mold is a sand component 18 whose function is to define regions within the resulting casting that is free from MMC. These may extend to water-ways or junk-slots and fluid feeder bores. A steel blank 24 is used to form an integral connection between the MMC drill bit body and a subsequently welded connection to a threaded pin.

Generally, any suitable contact infiltration or alternative suitable infiltration process may be used, for example dip infiltration, contact filtration, gravity fed infiltration, and external-pressure infiltration. Alternatively, the tool may be manufactured using liquid-phase sintering, where a metal component of the powder melts and fills pore space. An impregnation technique may also be alternatively used during which hydrocarbons are used to improve lubricity.

The mixture is generally, but not necessarily, poured into the mold 32,34. On pouring the density of the powder will be close to that measured by ATSM standard B212: Apparent Density of Free-Flowing Metal Powders Using the Hall Flowmeter Funnel. Such a packing arrangement is much lower than the full theoretical density measured by ATSM standard B923: Metal Powder Skeletal Density by Helium or Nitrogen Pycnometry and considered to be sub-optimal in terms of TRS, elastic modulus and wear protection of the resultant MMC. Low impact settling of the mold 16 with a hammer or other manual device achieves powder packing that is generally higher than free flowing the powders but lower than tapping the powders. An alternative method of compaction utilizes a vibro-compaction method. The mold may be coupled to a table of a vibro-compactor. High frequency axial movements are made via a rotating cam or servo-controlled hydraulic actuator. Frequencies are typically 100-10,000 Hz and acceleration between 0.1 and 50 G. Under vibro-compaction the packing arrangement advantageously can exceed that encountered by tapping. The vibration may not segregate the plurality of particles and the other plurality of particles because their densities are similar, which may not be the case when iron particles may be used, for example.

Dense packing may improve the capillary action that moves the molten braze material through the plurality of particles during binding in which the braze material infiltrates the interstices between the plurality of particles.

Table I lists various tests used to measure the density of the mixture, including apparent density, tap density, and powder skeletal density test. The relevant test standard is disclosed, as is description of the test.

TABLE 1

TESTS USED TO CALCULATE CARBIDE CONTENT AND INFILTRATION DENSITY

| No. | Test Name | ASTM Standard | Description |
|---|---|---|---|
| 1 | Apparent Density—AD | B212: Apparent Density of Free-Flowing Metal Powders Using the Hall Flowmeter Funnel | Determination of the apparent density of free-flowing metal powders. Is suitable for only those powders that will flow unaided through the specified Hall |

TABLE 1-continued

TESTS USED TO CALCULATE CARBIDE CONTENT AND INFILTRATION DENSITY

| No. | Test Name | ASTM Standard | Description |
|---|---|---|---|
| | | | flowmeter funnel. |
| 2 | Tap Density—TD | B527: Determination of Tap Density of Metallic Powders and Compounds | Determination of tap density (packed density) of metallic powders and compounds, that is, the density of a powder that has been tapped, to settle contents, in a container under specified conditions. |
| 3 | Powder Skeletal Density—PD (True Powder Density) | B923: Metal Powder Skeletal Density by Helium or Nitrogen Pycnometry | Determination of skeletal density of metal powders. |

The MMC's carbide content volume fraction percent is given by the function:

$$\frac{T}{P}\times 100\%$$

The MMC's infiltration density (low end) is given by the function:

$$\left(1-\frac{A}{P}\right)\times BDR\text{'s Density}+AD$$

The MMC's infiltration density (high end) is given by the function:

$$\left(1-\frac{A}{P}\right)\times BDR\text{'s Density}+TD$$

In the above equations, BDR is short for Binder Alloy.

Examples of calculated carbide content and infiltration density for MMC1 and MMC2 are now disclosed.

MMC 1:

$AD = 7.24$ g/cc; $TD = 8.93$ g/cc; $PD = 15.34$ g/cc;

$BDR$ density = 7.97 g/cc $$\text{Carbide Content in Volume Fraction (\%)} = \frac{T}{P}\times 100\% = \frac{8.9}{1.3}\times 100\% = 58.2\%$$

$$\text{Infiltration Density (low end)} = \left(1-\frac{A}{P}\right)\times BDR\text{'s Density}+AD = \left(1-\frac{7.2}{1.3}\right)\times 7.97+7.24 = 11.45\ \text{g/cc}$$

$$\text{Infiltration Density (high end)} = \left(1-\frac{T}{P}\right)\times BDR\text{'s Density}+TD = \left(1-\frac{8.9}{1.3}\right)\times 7.97+8.93 = 12.26\ \text{g/cc}$$

That is:

11.45<Infiltration Density<12.26 g/cc

MMC 2:

$AD = 7.85$ g/cc; $TD = 10.00$ g/cc; $PD = 15.53$ g/cc;

$BDR$ density = 7.97 g/cc $$\text{Carbide Content in Volume Fraction (\%)} = \frac{T}{P}\times 100\% = \frac{1.0}{1.5}\times 100\% = 64.4\%$$

$$\text{Infiltration Density (low end)} = \left(1-\frac{A}{P}\right)\times BDR\text{'s Density}+AD = \left(1-\frac{7.8}{1.5}\right)\times 7.97+7.85 = 11.79\ \text{g/cc}$$

$$\text{Infiltration Density (high end)} = \left(1-\frac{T}{P}\right)\times BDR\text{'s Density}+TD = \left(1-\frac{1.0}{1.5}\right)\times 7.97+10.00 = 12.84\ \text{g/cc}$$

That is:

11.79<Infiltration Density<12.84 g/cc

The distribution of tungsten carbide particles sizes for MMC2 was determined using a sieve analysis and is tabled in table 2.

TABLE 2

THE DISTRIBUTION OF TUNGSTEN CARBIDE PARTICLE SIZES FOR MMC2.

| US mesh | Diameter/μM | Weight % |
|---|---|---|
| +80 | >177 | 0.1% |
| −80/+120 | <177, >125 | 12.2% |
| −120/+170 | <125, >88 | 19.0% |
| −170/+230 | <88, >63 | 18.3% |
| −230/+325 | <63, >45 | 13.8% |
| −325 | <38 | 36.6% |

Table 3 lists properties of materials and their relative thermal shock resistance. Metallic tungsten (W) has a TSR that is on average 9.43 times that of WC, which may be why a relatively small amount of W improves the MMC's TSR. WC-6Co is 6 Wt. % Co.

Figure 8:
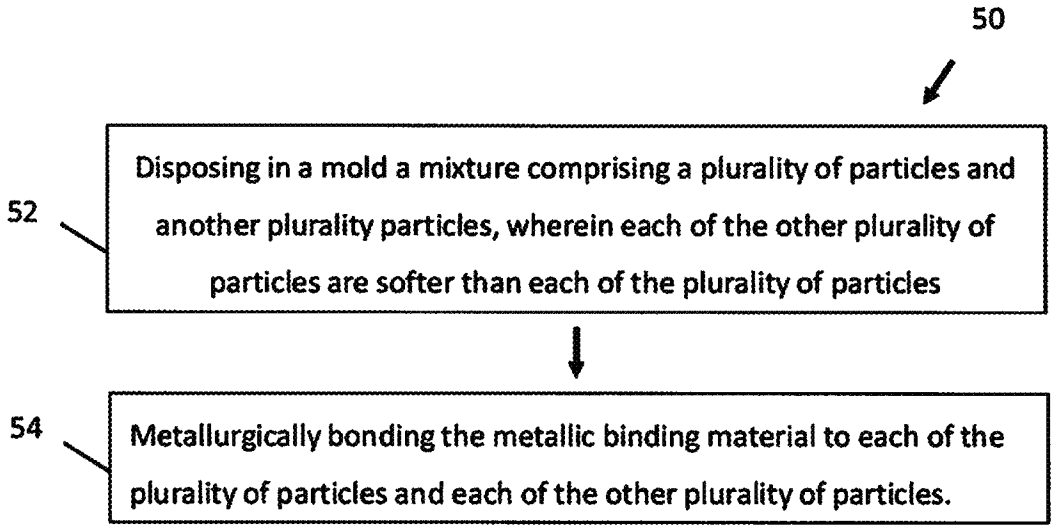
FIG. 8 shows a flow diagram of an embodiment of a method for making a metal matrix composite.

FIG. 8 shows a flow diagram of an embodiment of a method 50 for making a metal matrix composite (MMC). The method comprises the step 52 of disposing in a mold a mixture comprising a plurality of particles and another plurality of particles. Each of the other plurality of particles are softer than each of the plurality of particles. The method comprises the step 54 of metallurgically bonding the metallic binding material to each of the plurality of particles and each of the other plurality of particles. The embodiment 50 may generally comprise any one of more of the steps described above with respect of a method for making embodiments of a drill bit 10, as suitable and desired. The metal matrix composite may be a high reliability metal matrix composite.

Now that embodiments have been described, it will be appreciated that some embodiments may have some of the following advantages:

The disclosed embodiments of the MMCs and the tools made therefrom may be less likely to fracture during manufacture, repair or use, have increased strength, improved elastic modulus, increased Weibull modulus, and consequently have an increased lifespan.

There is a reduced probability of requiring early retrieval of the disclosed embodiments of drill bits from a hole, which may save considerable time and money.

There may be fewer repairs of a drill bit body, which may improve economics.

Blade or wing geometries may be modified advantageously. Increasing the height and decreasing the width of the blade increases the volume of space within the junk-slot region. This may promote more efficient cleaning of debris and drilling detritus from the cutting elements, thus improving drilling rates.

Drill bit manufacturers may specify recommended bit weights that can be applied safely. Increasing weight on the bit past historic limits may provide an increase in drilling rates.

Using Weibull statistics, a probabilistic approach may be taken to the likelihood of failure. Business decisions based on risk of failure for a given applied stress can be made.

TABLE 3

| | Tensile Strength (MPa)—σ | | Thermal Conductivity (W/m · K)—k | | Modulus of Elasticity/ Young's Modulus (GPa)—E | | Coefficient of Thermal Expansion ($1/K \times 10^{-6}$)—α | | Relative TSR |
|---|---|---|---|---|---|---|---|---|---|
| Material | MIN | MAX | MIN | MAX | MIN | MAX | MIN | MAX | to WC |
| W | 960 | 1510 | 155 | 174 | 390 | 411 | 4.5 | 4.6 | 943% |
| WC | 344 | 450 | 110 | 120 | 615 | 707 | 5.2 | 73 | 100% |
| Ni | 480 | | 91 | | 200 | | 13.4 | | 135% |
| Cu | 200 | | 400 | | 130 | | 16.5 | | 308% |
| Mn | 630 | 780 | 7.8 | | 198 | | 21.7 | | 11% |
| WC-6Co | 1440 | | 60 | 100 | 600 | 648 | 4.3 | 4.6 | 350% |
| Carbon Steel (1020) | 420 | 445 | 51.9 | | 205 | | 11.7 | 14.8 | 69% |

Variations and/or modifications may be made to the embodiments described without departing from the spirit or ambit of the invention. For example, while the described MMC comprises tungsten carbide partially substituted with tungsten metal bound together with a copper alloy braze, it will be appreciated other MMC compositions are possible. For example, the carbide may comprise titanium carbide, tantalum carbide, boron carbide, vanadium carbide or niobium carbide. The mixture may comprise boron nitride. The braze may be a nickel alloy, or generally any suitable metal. The present embodiments are, therefore, to be considered in all respects as illustrative and not restrictive. Reference to a feature disclosed herein does not mean that all embodiments must include the feature.

Prior art, if any, described herein is not to be taken as an admission that the prior art forms part of the common general knowledge in any jurisdiction.

In the claims which follow and in the preceding description of the invention, except where the context requires otherwise due to express language or necessary implication, the word "comprise" or variations such as "comprises" or "comprising" is used in an inclusive sense, that is to specify the presence of the stated features but not to preclude the presence or addition of further features in various embodiments of the invention.

The invention claimed is:

1. A drill bit comprising:

a body having a metal matrix composite (MMC), the MMC including:

a mixture comprising a plurality of particles having a first material and another plurality of particles having a second material, wherein a hardness of the first material is greater than a hardness of the second material such that a hardness of the mixture is less than the hardness of the first material, and a thermal conductivity of the second material is greater than a thermal conductivity of the first material, such that a thermal conductivity of the mixture is greater than the thermal conductivity of the first material; and a metallic binding material metallurgically bonded to each of the plurality of particles and to each of the other plurality of particles; and wherein the MMC exhibits a Weibull modulus greater than 20.

2. A drill bit defined by claim 1 wherein each particle of the other plurality of particles has a density that is in the range of 0.7-1.3 times that of each particle of the plurality of particles.

3. A drill bit defined by claim 1 wherein the thermal conductivity of the first material is no more than 120 $Wm^{-1}K^{-1}$.

4. A drill bit defined by claim 1 wherein the plurality of particles comprises at least one of a carbide and a nitride.

5. A drill bit defined by claim 1 wherein the plurality of particles comprises at least one of tungsten carbide, cemented tungsten carbide (WC-Co), cadmium carbide, tantalum carbide, vanadium carbide and titanium carbide.

6. A drill bit defined by claim 1 wherein the plurality of particles comprises at least one of WC and fused tungsten carbide.

7. A drill bit defined by claim 1 wherein the thermal conductivity of the second material is no less than 155 $Wm^{-1}K^{-1}$.

8. A drill bit defined by claim 1 wherein the other plurality of particles comprises a metal.

9. A drill bit defined by claim 1 wherein the other plurality of particles comprises a plurality of tungsten metal particles.

10. A method of making a body of a drill bit comprising a metal matrix composite (MMC), the method comprising the steps of:

disposing in a mold configured for forming the body of the drill bit a mixture comprising a plurality of particles having a first material and another plurality of particles having a second material, wherein a hardness of the first material is greater than a hardness of the second material such that a hardness of the mixture is less than the hardness of the first material, and a thermal conductivity of the second material is greater than a thermal conductivity of the first material, such that a thermal conductivity of the mixture is greater than the thermal conductivity of the first material; and metallurgically bonding a metallic binding material to the plurality of particles and to the other plurality of particles to form the body of the drill bit comprising the MMC, the MMC exhibiting a Weibull modulus greater than 20.

11. A method defined by claim 10 wherein each particle of the other plurality of particles has a density that is in the range of 0.7-1.3 times that of each particle of the plurality of particles.

12. A method defined by claim 10 wherein the thermal conductivity of the first material is no more than 120 $Wm^{-1}K^{-1}$.

13. A method defined by claim 10 wherein the plurality of particles comprises at least one of a carbide and a nitride.

14. A method defined by claim 10 wherein each of the plurality of particles comprises at least one of tungsten carbide, cemented tungsten carbide (WC-Co), cadmium carbide, tantalum carbide, vanadium carbide and titanium carbide.

15. A method defined by claim 10 wherein the plurality of particles comprises at least one of WC and fused tungsten carbide.

16. A method defined by claim 10 wherein the thermal conductivity of the second material is no less an 155 $Wm^{-1}K^{-1}$.

17. A method defined by claim 10 wherein the other plurality of particles comprises a metal.

18. A method defined by claim 10 wherein the other plurality of particles comprises a plurality of tungsten metal particles.

19. A drill bit, comprising:

a body having a metal matrix composite (MMC), the MMC including:

a mixture comprising a plurality of particles having a first material and another plurality of particles having a second material, wherein a hardness of the first material is greater than a hardness of the second material such that a hardness of the mixture is less than the hardness of the first material, and a thermal conductivity of the second material is greater than a thermal conductivity of the first material, such that a thermal conductivity of the mixture is greater than the thermal conductivity of the first material; and a metallic binding material metallurgically bonded to each of the plurality of particles and to each of the other plurality of particles; and wherein the MMC exhibits a Weibull modulus greater than 20; and wherein the first material comprises at least one of tungsten carbide, cemented tungsten carbide (WC-Co), cadmium carbide, tantalum carbide, vanadium carbide and titanium carbide.

20. The drill bit of claim 19, wherein the second material comprises a metal.

* * * * *